US008320605B2

(12) United States Patent
Dodd

(10) Patent No.: US 8,320,605 B2
(45) Date of Patent: Nov. 27, 2012

(54) ELECTRO-ACOUSTIC TRANSDUCER

(75) Inventor: Mark Dodd, Woodbridge (GB)

(73) Assignee: KH Technology Corporation, George Town (KY)

( * ) Notice: Subject to any disclaimer, the term of this patent is extended or adjusted under 35 U.S.C. 154(b) by 1109 days.

(21) Appl. No.: 11/885,612

(22) PCT Filed: Mar. 2, 2006

(86) PCT No.: PCT/GB2006/000737

§ 371 (c)(1),
(2), (4) Date: Jun. 16, 2008

(87) PCT Pub. No.: WO2006/092596

PCT Pub. Date: Sep. 8, 2006

(65) Prior Publication Data

US 2009/0022356 A1 Jan. 22, 2009

(30) Foreign Application Priority Data

Mar. 2, 2005 (GB) ..... 0504274.2

(51) Int. Cl.
*H04R 11/02* (2006.01)

(52) U.S. Cl. ..... 381/430

(58) Field of Classification Search ..... 381/430, 381/340, 342, 344

See application file for complete search history.

(56) References Cited

U.S. PATENT DOCUMENTS

| | | | | |
|---|---|---|---|---|
| 3,119,888 | A * | 1/1964 | Supitilov | 264/137 |
| 4,531,608 | A | 7/1985 | Heinz | |
| 5,285,025 | A | 2/1994 | Yoshioka et al. | |
| 5,548,657 | A | 8/1996 | Fincham | |
| 5,907,133 | A | 5/1999 | Agostinelli et al. | |
| 6,757,404 | B2 | 6/2004 | Takewa et al. | |
| 2002/0061117 | A1 | 5/2002 | Takewa et al. | |
| 2002/0094107 | A1 | 7/2002 | Cork | |
| 2004/0202342 | A1 * | 10/2004 | Anthony et al. | 381/342 |

FOREIGN PATENT DOCUMENTS

| | | | |
|---|---|---|---|
| DE | 3018659 | A1 | 11/1981 |
| EP | 1173042 | A2 | 1/2002 |
| EP | 1515583 | A | 3/2005 |
| FR | 2428952 | A3 | 4/1978 |
| GB | 2166023 | A | 4/1986 |
| GB | 2261135 | A | 5/1993 |

(Continued)

OTHER PUBLICATIONS

Japanese Office Action mailed Jul. 12, 2011 for Japanese Patent Application No. 2007-557585, pp. 1-4, Japan Patent Office, Japan (English-language translation included, pp. 1-4).

(Continued)

*Primary Examiner* — Jianchun Qin

(74) *Attorney, Agent, or Firm* — Kenneth L. Sherman, Esq.; Michael Zarrabian, Esq.; Sherman & Zarrabian LLP

(57) ABSTRACT

An electro-acoustic transducer with a front part having an acoustically radiating surface, a supporting part that supports the front part and that extends from a peripheral region of the front part in a direction away from the acoustically radiating surface, and a reinforcing part that provides rigidity to the transducer. The reinforcing part extends from the supporting part to the front part such that a portion of the reinforcing part is spaced from the front part and/or the supporting part.

20 Claims, 3 Drawing Sheets

FOREIGN PATENT DOCUMENTS

| | | | |
|---|---|---|---|
| GB | 2364847 | A | 2/2002 |
| GB | 2377849 | A | 1/2003 |
| JP | 50144426 | A | 11/1975 |
| JP | 54023892 | Y2 | 8/1979 |
| JP | 56007358 | B2 | 2/1981 |
| JP | 60 171897 | A | 9/1985 |
| JP | 02-238798 | A | 9/1990 |
| JP | 08163694 | A | 6/1996 |
| JP | 08168092 | A | 6/1996 |
| JP | 10042389 | A | 2/1998 |
| WO | WO 2004-089037 | A | 10/2004 |

OTHER PUBLICATIONS

The Patent Office, Search Report for Patent Application No. GB0504274.2 dated on May 18, 2005, 3 pages.

PCT International Search Report, PCT/GB2006/00737 dated Jun. 26, 2006.

PCT International Search Report, PCT/GB2006/00753, dated Jun. 26, 2006.

The Patent Office (United Kingdom), Search Report for Patent Application No. GB0504248.6 dated on May 17, 2005, 3 pages.

* cited by examiner

ELECTRO-ACOUSTIC TRANSDUCER

CROSS REFERENCE TO RELATED APPLICATIONS

The present application is a national stage application under 35 U.S.C. 371 of PCT/GB2006/000737 filed Mar. 2, 2006, which claims priority of GB 0504274.2 filed Mar. 2, 2005, both applications being hereby incorporated by reference in their entirety.

BACKGROUND OF THE INVENTION

The present invention relates to electro-acoustic transducers, and especially to such transducers for use in loudspeakers. The invention particularly relates to dome-shaped transducers, for example high frequency transducers commonly referred to as "tweeters".

Rigid ("hard") dome-shaped electro-acoustic transducers arranged to radiate high frequency acoustic waves (for example above about 15 kHz) have been used in loudspeakers for many years. It is fundamental to their ideal functioning that such hard dome-shaped transducers are substantially rigid (such that they exhibit minimal flexing during use) and have a low mass (such that the maximum proportion of input power is converted to acoustic output power). These twin objectives have hitherto been achieved by a combination of the inherent structural rigidity of the dome shape, and the use of low density materials, including plastics materials, low density metals and metal alloys, ceramics and composite materials.

Specific examples of the huge number of known dome-shaped electro-acoustic transducers include those disclosed by U.S. Pat. Nos. 4,531,608 and 6,757,404 B2, among many others.

BRIEF SUMMARY OF THE INVENTION

The present invention seeks to provide an improved electro-acoustic transducer that is able to combine the twin properties of high rigidity and low mass while being less constrained in its shape than hitherto.

Accordingly, a first aspect of the invention provides an electro-acoustic transducer, comprising a front part having an acoustically radiating surface, a supporting part that supports the front part and that extends from a peripheral region of the front part in a direction away from the acoustically radiating surface, and a reinforcing part that provides rigidity to the transducer, wherein the reinforcing part extends from the supporting part to the front part such that a portion of the reinforcing part is spaced from the front part and/or the supporting part.

The invention has the advantages that by providing a reinforcing part to the transducer extending between the supporting part and the front part, yet spaced from the front part and/or the supporting part, the transducer can be made with high rigidity and low mass while providing a great deal of technical design freedom in the shape of the acoustically radiating surface. Consequently, the invention provides a radical departure from known dome-shaped transducers by substantially avoiding the need for the acoustically radiating part of the transducer to provide the required rigidity by means of its shape. Instead, the shape of the acoustically radiating part of the transducer according to the invention can be determined primarily, or (preferably) substantially entirely, by acoustic rather than mechanical considerations.

In preferred embodiments of the invention, a portion of the reinforcing part is spaced from both the front part and the supporting part. The reinforcing part is situated behind the front part of the transducer.

Preferably the supporting part extends substantially from the periphery of the front part. The periphery of the front part preferably is substantially circular. Advantageously, the supporting part may be substantially cylindrical.

Preferably, at least the portion of the reinforcing part that is spaced from the front part and/or the supporting part, is substantially in the shape of a dome or a truncated dome. Advantageously, the dome or truncated dome of the reinforcing part may have a substantially spherical or substantially spheroid curvature. Alternatively, at least the portion of the reinforcing part that is spaced from the front part and/or the supporting part may be substantially in the shape of a cone or a truncated cone, for example. The reinforcing part may be substantially continuous, e.g. around an axis of the transducer. Alternatively, the reinforcing part may comprise a plurality of sections, e.g. spaced apart from each other. Such sections may comprise reinforcing struts, for example. The reinforcing part may be perforated or porous, for example.

Preferably the reinforcing part and/or the supporting part and/or the front part is/are formed from one or more sheets of material.

In preferred embodiments of the invention, the front part of the transducer is dome-shaped. Preferably the acoustically radiating surface of the front part is dome-shaped, and most preferably has substantially the shape of a segment of a sphere.

Preferably, a radius, or a minimum radius, of the acoustically radiating surface of the front part is greater than a radius, or a maximum radius, of at least the portion of the reinforcing part that is spaced from the front part and/or the supporting part.

In at least some preferred embodiments of the invention, the reinforcing part of the transducer that is spaced apart from the front part and/or the supporting part, is so spaced by a maximum of 5 mm, more preferably a maximum of 3 mm, even more preferably a maximum of 1 mm, especially a maximum of 0.5 mm, e.g. a maximum of 0.3 mm.

Preferably the acoustically radiating surface of the transducer according to the invention has a diameter of at least 10 mm, more preferably at least 15 mm, e.g. approximately 19 mm. Preferably the acoustically radiating surface of the transducer has a diameter of no greater than 120 mm, preferably no greater than 100 mm, more preferably no greater than 80 mm, even more preferably no greater than 60 mm, especially no greater than 40 mm.

The dome-shaped transducer preferably is formed from a substantially rigid low density material, for example a metal or metal alloy material, a composite material, a carbon fibre material, a plastics material, or a ceramic material. Some preferred metals for forming a suitable metal or metal alloy material include: titanium; aluminium; and beryllium. The acoustically radiating surface of the dome-shaped transducer may be formed from a specialist material, for example diamond (especially chemically deposited diamond).

A second aspect of the invention provides a loudspeaker comprising at least one transducer according to the first aspect of the invention. The loudspeaker may include one or more further transducers and/or one or more acoustically radiating diaphragms, for example.

A third aspect of the invention provides a loudspeaker system comprising a plurality of loudspeakers according to the second aspect of the invention.

Other preferred and optional features of the Invention are described below and in the dependent claims.

BRIEF DESCRIPTION OF THE DRAWINGS

An example of a preferred embodiment of the invention will now be described, by way of example, with reference to the accompanying drawings, of which.

DETAILED DESCRIPTION OF THE PREFERRED EMBODIMENTS

Figure 1:
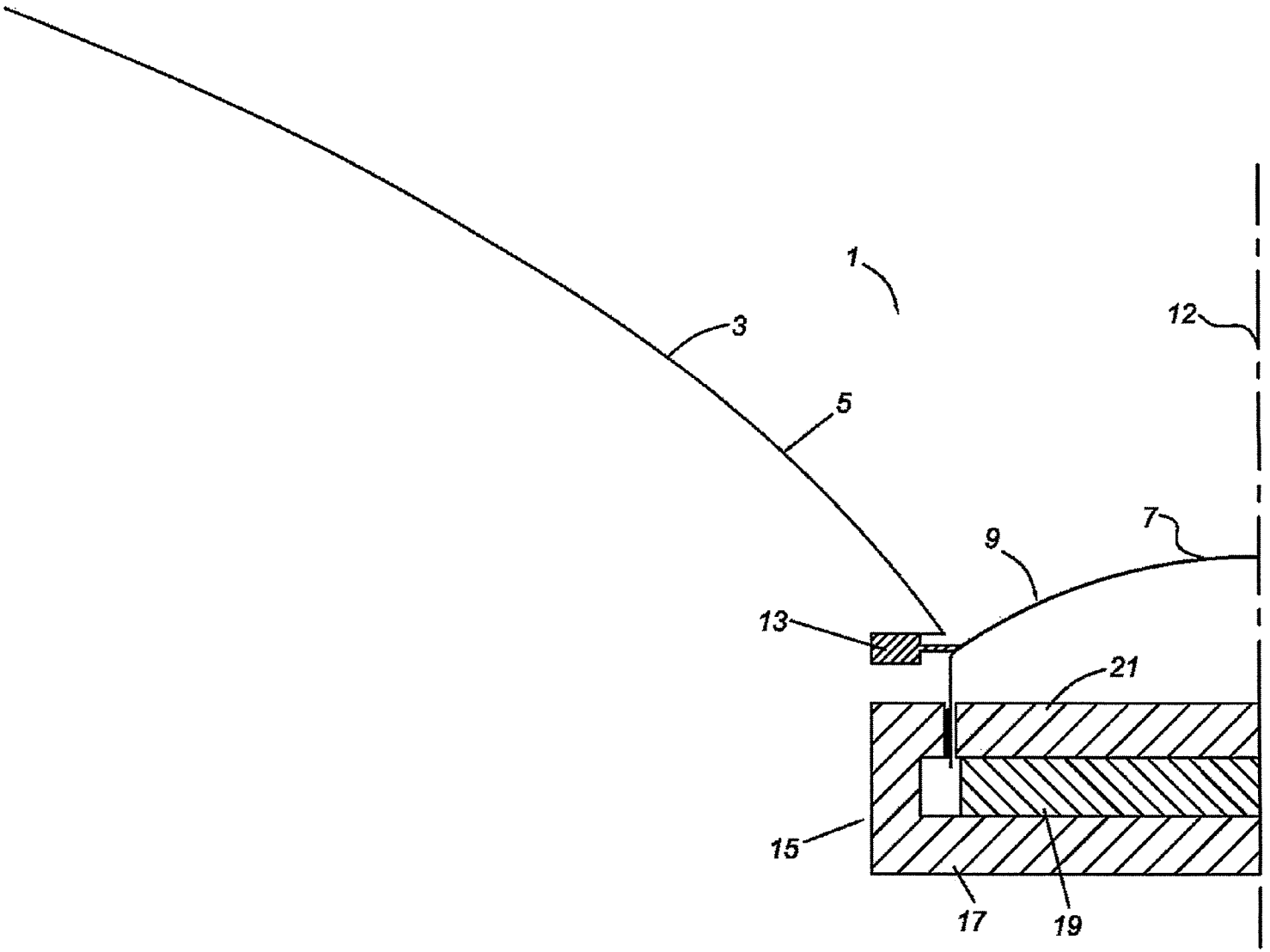
FIG. 1 shows, schematically and in cross-section, part of a loudspeaker incorporating an electro-acoustic transducer according to the invention.
Figure 2:
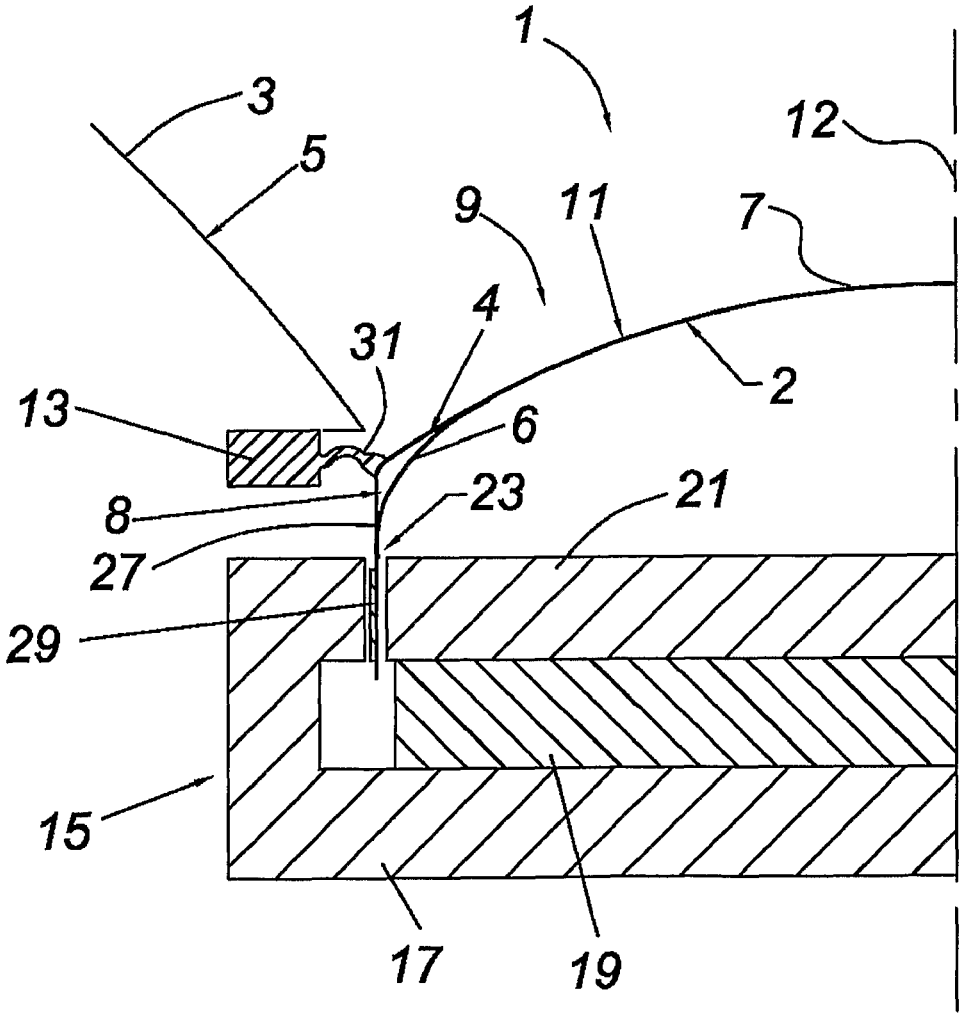
FIG. 2 shows a detail of FIG. 1, illustrating in particular an electro-acoustic transducer according to the invention.

FIGS. 1 and 2 show, schematically and in cross-section, part of a loudspeaker 1 according to the present invention. (Both figures show only one half of the loudspeaker on one side of a longitudinal axis 12. The loudspeaker is symmetrical about the axis.) The loudspeaker 1 comprises a horn waveguide 3 having a waveguide surface 5, and a convex dome-shaped transducer 7 according to the invention located generally in the throat 9 of the horn waveguide. The convex dome-shaped transducer 7 has a substantially rigid acoustically radiating surface 11, which preferably is shaped substantially as a segment of a sphere (I.e. the curvature of the surface 11 is a substantially spherical curvature). The transducer 7 includes a reinforcing part 6, which is shown in FIG. 2, but for clarity is not shown in FIG. 1. The horn waveguide 3 is a generally frusto-conical flared static waveguide having a longitudinal axis 12. A surround 13 of the dome-shaped transducer 7 is attached to the horn waveguide 3 behind the throat 9.

A drive unit 15 of the dome-shaped transducer 7 comprises a pot 17, a disc-shaped magnet 19 and a disc-shaped inner pole 21. The pot 17 is substantially cylindrical and has an opening 23 to receive the disc-shaped magnet 19 and the inner pole 21. The opening 23 is defined by a radially-inwardly extending lip 25 that forms an outer pole of the drive unit 15. A substantially cylindrical supporting part (or former) 27 of the dome-shaped transducer 7 carries a coil 29 of an electrical conductor (e.g. a wire) that is wound around the supporting part 27. The coil 29 and supporting part 27 extend between the Inner and outer poles 21 and 25 of the drive unit. The dome-shaped transducer 7 is driven substantially along the axis 12 by the drive unit, and is stabilized by the surround 13. A flexible web part (or seal part) 31 of the surround permits the axial movement of the transducer 7. Preferably at least an outer 50% of the radial width of the web part 31 of the surround 13 is overlapped by the throat 9 of the horn waveguide.

FIG. 2 shows part of the electro-acoustic transducer 7 in detail. The transducer 7 comprises a front part 2 having an acoustically radiating surface 11, a supporting part (or former) 27 that supports the front part and that extends from a peripheral region 4 of the front part in a direction away from the acoustically radiating surface, and a reinforcing part 6 that provides rigidity to the transducer. The reinforcing part 6 extends from the supporting part 27 to the front part 2 such that a portion of the reinforcing part is spaced from the front part and/or the supporting part by a gap 8. The rigidity provided to the transducer 7 by the reinforcing part 6 provides a great degree of design freedom in the shape of the acoustically-radiating surface 11, so that the surface may be designed substantially entirely to acoustic criteria rather than mechanical criteria. Also, the fact that a portion of the reinforcing part is spaced from the front part 2 and the supporting part 27 means that the reinforcing part can be low in mass, thereby contributing only minimal inertial mass to the transducer (which is advantageous because the lower the mass of the transducer 7 the greater proportion of applied electrical power is converted to acoustic power).

Preferably, as illustrated, the reinforcing part (or at least the portion spaced from the supporting part and/or the front part of the transducer) comprises a thin sheet of material. The reinforcing part preferably comprises a sheet of material having substantially the same thickness as the material from which the front part and/or the supporting part of the transducer preferably is/are formed. Alternatively, however, the reinforcing part may be thicker or thinner than the material from which the front part and/or the supporting part of the transducer is/are formed. Also, the reinforcing part may be formed from the same material as the front part and/or the supporting part, or it may be formed from a different material. For example, the reinforcing part may be formed from carbon fibre material. As illustrated, the reinforcing part preferably comprises a truncated dome that extends between the supporting part and the front part of the transducer. Advantageously, the reinforcing part transfers forces between the supporting part and the front part of the transducer in a progressive manner.

Figure 3:
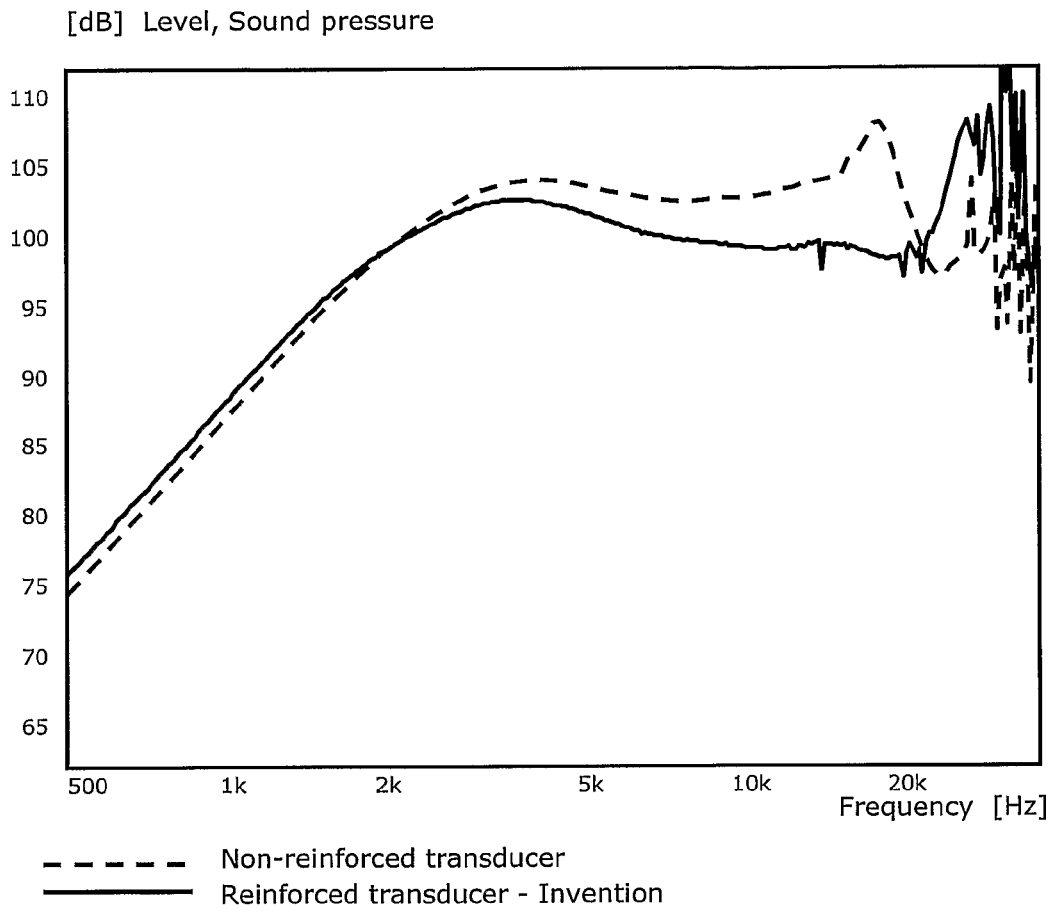
FIG. 3 shows a graphical representation of sound pressure level (in dB) versus sound frequency (in Hz) modelled for a reinforced transducer according to the invention compared to that for a transducer having the same shape of acoustically radiating surface but not reinforced (and thus falling outside the scope of the invention).

FIG. 3 shows a graphical representation of sound pressure level (in dB) versus sound frequency (in Hz) modelled on computer by finite element analysis for a reinforced transducer according to the invention compared to that for a transducer having the same shape of acoustically radiating surface but not reinforced (and thus falling outside the scope of the invention). The structure of the computer-modelled transducer according to the invention was as shown in FIG. 2. The structure of the computer-modelled non-reinforced transducer was the same as that shown in FIG. 2 except that the reinforcing part 6 was omitted.

As the skilled person knows, in order for an electro-acoustic transducer to perform adequately it is necessary for the sound pressure level of sounds produced by the transducer to be as constant as practicable (for a given input power) over substantially the entire operating sound frequency range of the transducer. For preferred transducers according to the invention, the operating frequency range will normally be from about 5 kHz to about 20 kHz (or possibly higher; for Super Audio Compact Disc (SACD) systems, for example, the operating frequency range extends above 20 kHz). It is therefore desired for transducers according to the invention to have a sound pressure level response over this frequency range that is as constant ("flat") as possible.

FIG. 3 clearly shows that the modelled reinforced transducer according to the invention exhibited a significantly flatter sound pressure level response than did the non-reinforced transducer, particularly over the frequency range from 10 kHz to 20 kHz (which is the most important range for high frequency transducers, i.e. "tweeters"). Consequently, the reinforced transducer according to the invention demonstrates a clear acoustic advantage over non-reinforced transducers.

The invention claimed is:

1. An electro-acoustic transducer, comprising:

a front part having an acoustically radiating surface;

a supporting part that supports the front part and that extends from a peripheral region of the front part in a direction away from the acoustically radiating surface; and a reinforcing part that provides rigidity to the transducer by extending from tangential engagement with the supporting part to tangential engagement with the front part such that a portion of the reinforcing part is spaced from the front part and the supporting part.

2. A transducer according to claim 1, wherein the supporting part extends from the peripheral region of the front part.

3. A transducer according to claim 1, wherein the peripheral region of the front part is circular.

4. A transducer according to claim 1, wherein the peripheral region of the front part is cylindrical.

5. A transducer according to claim 1, wherein:

at least the portion of the reinforcing part that is spaced from the front part and the supporting part has a truncated dome shape.

6. A transducer according to claim 5, wherein the truncated dome of the reinforcing part has a spherical curvature.

7. A transducer according to claim 1, wherein at least the portion of the reinforcing part that is spaced from the front part and the supporting part is continuous.

8. A transducer according to claim 1, wherein at least one of the reinforcing part, the supporting part, and the front part is formed from one or more sheets of material.

9. A transducer according to any one of claim 1, wherein at least the portion of the reinforcing part that is spaced from the front part and the supporting part comprises a plurality of sections.

10. A transducer according to claim 9, wherein at least some of the plurality of sections are spaced apart from each other.

11. A transducer according to claim 9, wherein at least some of the plurality of sections comprise reinforcing struts.

12. A transducer according to claim 1, wherein the reinforcing part is perforated.

13. A transducer according to claim 1, wherein the front part is dome-shaped.

14. A transducer according to claim 1, wherein the acoustically radiating surface of the front part is dome-shaped.

15. A transducer according to claim 1, wherein the acoustically radiating surface of the front part has a shape of a segment of a sphere.

16. A transducer according to claim 1, wherein a minimum radius of the acoustically radiating surface of the front part is greater than a maximum radius of at least the portion of the reinforcing part that is spaced from the front part and the supporting part.

17. A transducer according to claim 1, further comprising a coiled electrical conductor carried by the supporting part.

18. A transducer according to claim 1, further comprising a magnet forming part of a drive unit for the transducer.

19. A loudspeaker comprising a transducer according to claim 1, wherein the loudspeaker further comprises at least one of a plurality of transducers and a plurality of acoustically radiating diaphragms.

20. A loudspeaker system comprising a plurality of loudspeakers, wherein each of the plurality of loudspeakers comprises:

a front part having an acoustically radiating surface;

a supporting part that supports the front part and that extends from a peripheral region of the front part in a direction away from the acoustically radiating surface; and a reinforcing part that provides rigidity to the loudspeaker by extending from tangential engagement with the supporting part to tangential engagement with the front part such that a portion of the reinforcing part is spaced from the front part and the supporting part.

* * * * *